US010060219B2

(12) United States Patent
Mowbray et al.

(10) Patent No.: US 10,060,219 B2
(45) Date of Patent: Aug. 28, 2018

(54) CEMENTING TOOL

(71) Applicant: Pivotal Downhole Oil Tools, L.L.C., New Iberia, LA (US)

(72) Inventors: Kyle Mowbray, Houston, TX (US); Lee Robichaux, Lafayette, LA (US); Kris Henderson, Lafayette, LA (US)

(73) Assignee: Premiere, Inc., New Iberia, LA (US)

( * ) Notice: Subject to any disclaimer, the term of this patent is extended or adjusted under 35 U.S.C. 154(b) by 359 days.

(21) Appl. No.: 14/376,873

(22) PCT Filed: Feb. 7, 2013

(86) PCT No.: PCT/US2013/025150

§ 371 (c)(1),
(2) Date: Aug. 6, 2014

(87) PCT Pub. No.: WO2013/119814

PCT Pub. Date: Aug. 15, 2013

(65) Prior Publication Data

US 2015/0000891 A1 Jan. 1, 2015

Related U.S. Application Data

(60) Provisional application No. 61/595,966, filed on Feb. 7, 2012, provisional application No. 61/644,090, filed on May 8, 2012.

(51) Int. Cl.

| | |
|---|---|
| ***E21B 33/16*** | (2006.01) |
| ***E21B 47/00*** | (2012.01) |
| ***E21B 33/05*** | (2006.01) |

(52) U.S. Cl.
CPC ..... *E21B 33/16* (2013.01); *E21B 33/05* (2013.01); *E21B 47/00* (2013.01)

(58) Field of Classification Search
CPC ..... E21B 33/16; E21B 33/05
See application file for complete search history.

(56) References Cited

U.S. PATENT DOCUMENTS

| | | | | |
|---|---|---|---|---|
| 5,553,667 | A | 9/1996 | Budde et al. | |
| 5,890,537 | A | 4/1999 | Lavaure et al. | |
| 6,206,432 | B1 | 3/2001 | Kamiyama | |
| 8,749,399 | B2 * | 6/2014 | Petrovic | G01V 11/002 175/40 |
| 2005/0194152 | A1 | 9/2005 | Campo | |
| 2010/0175891 | A1 | 7/2010 | Rondeau et al. | |
| 2011/0240301 | A1 | 10/2011 | Robison et al. | |
| 2011/0253361 | A1 | 10/2011 | Matherne, Jr. et al. | |

FOREIGN PATENT DOCUMENTS

WO WO2011/057416 A1 5/2011

* cited by examiner

*Primary Examiner* — David J Bagnell
*Assistant Examiner* — Brandon M Duck
(74) *Attorney, Agent, or Firm* — Russel O. Primeaux; Kean Miller LLP

(57) ABSTRACT

An improved cementing tool is presented which allows for relatively easy removal and insertion of the tool through the use of non-threaded low-torque connections. The cementing tool uses a combination of threaded connections and non-threaded, low-torque connections configured to create a stack of components including plug launchers, ball launchers and plug launch indicator/counters. Use of non-threaded low-torque connections allows for breaking down the tool by hand, requiring no special torquing equipment.

10 Claims, 9 Drawing Sheets

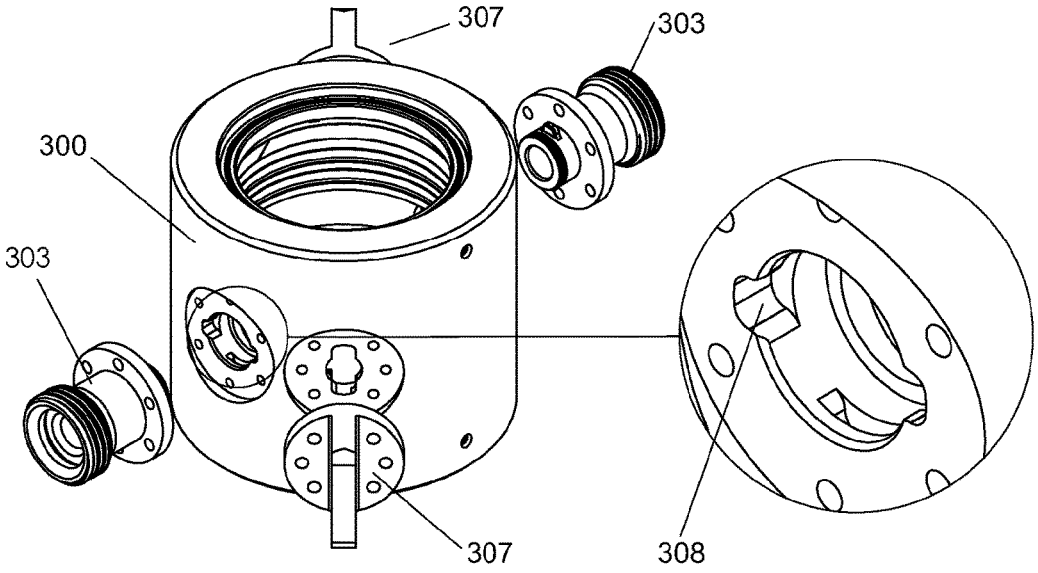
Fig. 4
Fig. 4a
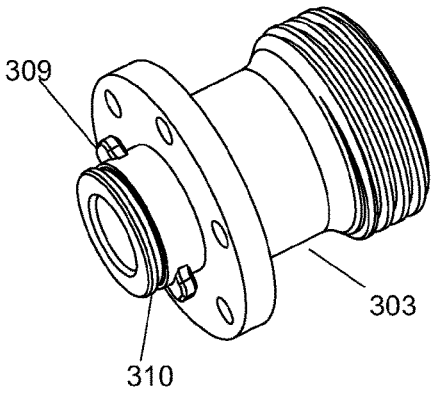
Fig. 5
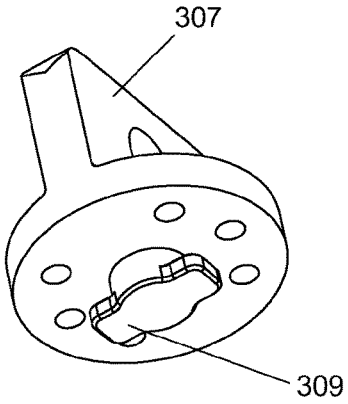
Fig. 6

CEMENTING TOOL

CROSS-REFERENCE TO RELATED APPLICATIONS

This application is filed under the provisions of 35 U.S.C. § 371 and claims the priority of International Patent Application No. PCT/US13/025150 filed on Feb. 7, 2013 which claims priority to U.S. Provisional Patent Application No. 61/595,966 filed on Feb. 7, 2012 and U.S. Provisional Patent Application No. 61/644,090 filed on May 8, 2012, all of which are hereby incorporated herein by reference in their entireties.

STATEMENTS AS TO RIGHTS TO THE INVENTION MADE UNDER FEDERALLY SPONSORED RESEARCH AND DEVELOPMENT

None

TECHNICAL HELD

This invention relates, in general, to equipment utilized in conjunction with operations performed in construction of subterranean wells and, in particular, to a downhole cementing tool assembly. This assembly is capable of facilitating rapid connection and disconnection of the cementing tool and replacement/repair of components of the tool through modularization.

BACKGROUND

Wells, such as oil and gas wells, are initially constructed by drilling to the desired depth in the subsurface. Among the steps in completing such wells is the running of casing followed by the cementing of the annular space between the outside of the casing and the circumference of the drilled hole. To accomplish cementing of the annular space, a cementing tool apparatus is incorporated with a drill string of smaller diameter pipe used to communicate the cement from the surface (ground level) to desired down hole location. Pipe, that is used to communicate cement, is connected via threaded male and female couplings that require rotation of the pipe to make-up the threads. This rotation (make-up) requires torque applied to the pipe/connections; the applied torque induces bearing loads between the threads.

Connecting and removing the cementing tool, to and from the pipe (at the bottom of the tool) and the top drive or traveling block (at the top of the tool) requires time and torque. Cementing tools are usually provided as a complete and indivisible unit, frequently joined or made-up at a shop facility prior to transfer to a rig or other work site. If any problem occurs or there is a desired change in the cementing plan, the entire tool is removed and a new tool installed. An advantage would accrue during cementing operations where the tool could be made-up to the drill pipe by use of rapid connect/disconnect couplings, and where the cementing tool itself can be broken down just as easily to repair or change the configuration of the cementing tool. This can be accomplished with a modularized cementing tool with non-threaded, low-torque connectors both at the outer-end and internal to the tool.

DISCLOSURE

Embodiments disclosed herein may be used for the purpose of efficient cementing of the annular space between a well's casing and the well borehole. Embodiments of the improved cementing head allow for relatively easy removal and insertion of the tool through the use of non-threaded, low-torque connections. The cementing tool uses a combination of threaded connections and non-threaded, low-torque connections, configured to create a stack of components including plug launchers, ball launchers and plug launch indicators/counters. Use of non-threaded, low-torque connections allows for breaking down the tool by hand, requiring no special torquing equipment.

BRIEF DESCRIPTION OF THE DRAWINGS

FIG. 4 shows a diagonal top and side view of the cement swivel, including diagonal top and side views of the twist lock bolted cement nozzle connection and the twist lock bold back torque padeye.

FIG. 4*a* shows an exploded view of the female twist lock pocket located in the side of the cement swivel.

FIG. 5 shows an exploded view of the twist lock bolted cement nozzle connection with one end comprising a male twist lock and the other end a threaded male connection.

FIG. 6 shows an exploded view of the twist lock hold back torque padeye with one end having a male twist lock for connecting to the twist lock bolted cement nozzle connection.

MODES FOR CARRYING OUT THE INVENTION

Figure 1:
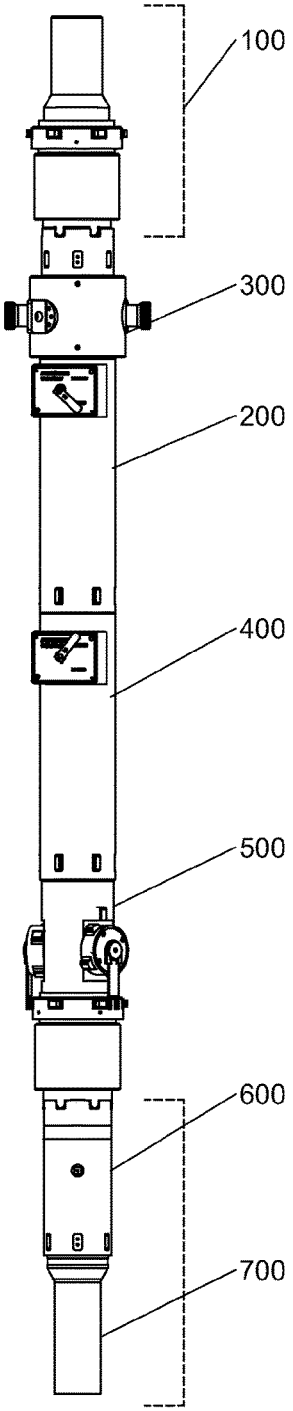
FIG. 1 shows the side view of a fully assembled cementing tool comprising multiple components. Components identified within this figure include a non-threaded, low-torque connector assembly, an upper plug launcher, a cement swivel, a lower plug launcher, a ball drop/flag sub, a shut-in valve and a casing sub. The non-threaded, low-torque connectors shown in FIG. 1 are ball lock assemblies.

Referring now to FIG. 1, a side view of one embodiment of the improved cementing tool is presented with various components stacked and connected in an operable manner. The improved cementing tool is connected directly to the casing sub 700. When considering the upper portion of the improved tool, as presented in FIG. 1, the top component, upper connector assembly 100, is configured to accept a connector, typically threaded, from the top drive or traveling block to the top of the upper connector assembly 100 and configured to connect to lower components with a connector connection. In this embodiment, the lower end of the upper connector assembly 100 is adjacent to upper end of the cement swivel 300. The cement swivel 300 is attached to the upper portion of the upper plug launcher 200.

Continuing down the improved cementing tool, the lower portion of the upper plug launcher 200 is connected to the upper portion of the lower plug launcher 400. In this embodiment, the upper plug launcher 200 is different from the lower plug launcher 400, as the upper plug launcher incorporates the cement swivel 300. In another embodiment, where the cement swivel is a separate entity, plug launchers may be interchangeable, with no real difference from the upper and lower plug launchers except for their relative position when connected. If desired, the improved cementing tool can be configured without plug launchers or with multiple plug launchers. The number of plug launchers is limited only by the available vertical space on the improved cementing tool. Typically, cementing jobs will require two cement plugs. Continuing down the improved cementing tool, the lower end of the bottom most plug launcher is connected to the top of the ball drop/flag sub 500 component. The lower end of the ball drop/flag sub 500 component is connected to the top of the shut-in ball valve 600. Finally, the lower end of the shut-in ball valve 600 is connected to the upper portion of the threaded casing 700.

All components may be connected together utilizing non-threaded, low-torque connections, except for connections to casing and other threaded entities such as exist at the top of the tool. Other connections may be utilized in connecting the various components, however where possible, quick non-torquing connections are preferred, allowing for relatively easy replacement of components with similar units.

Figure 1A:
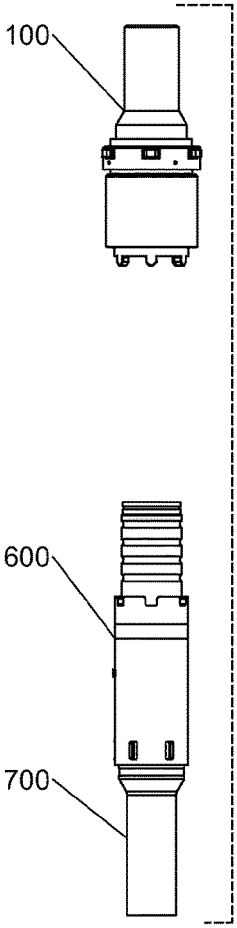
FIG. 1*a* shows an exploded view of the system described in FIG. 1 with the cement swivel, plug launchers, and flag sub removed. Components presented in the figure include a non-threaded, low-torque connector assembly a shut-in valve and a casing sub. The non-threaded, low-torque connectors shown in FIG. 1*a* are ball lock assemblies.
Figure 1B:
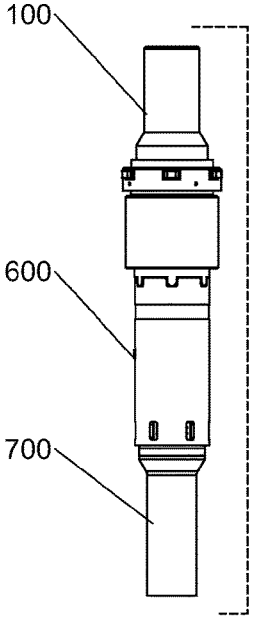
FIG. 1*b* shows the direct connection of the non-threaded, low-torque connector assembly and a shut-in valve. The non-threaded, low-torque connectors shown in FIG. 1*b* are ball lock assemblies.

Referring now to FIG. 1*a*, the improved cementing tool is shown with the cementing swivel 300, upper plug launcher 200, lower plug launcher 400, ball drop flag sub 500 removed and the remaining components disconnected. FIG. 1*b* illustrates that the lower portion of the upper connector assembly 100 can be directly attached to the upper portion of the shut in valve 600 component. When configured as discussed within this paragraph, i.e., when the upper connector assembly 100 is connected directly to the non-threaded, low-torque connection on the shut-in ball valve 600, mud can be circulated directly from the top drive. Additionally, cement plugs 216 may be launched manually under this configuration since non-threaded, low-torque connections may be easily broken.

Considering FIGS. 1, 1*a* and 1*b* together illustrates the ease with which the improved cementing tool may be inserted and removed from the top of the casing, without the need to disconnect screwed type connectors. Furthermore, where components between the upper connector assembly 100 and the shut-in valve 600 component have quick non-torquing connections, each one individually, or in a group can be quickly removed from the tool and replaced with another comparable component. Although the embodiment illustrated within FIGS. 1, 1*a* and 1*b* utilizes only non-threaded, low-torque connectors on the top and bottom of the fully configured cementing tool, other embodiments may include additional connectors, allowing for removal and replacement, if applicable, of individual components within the cementing tool.

Figure 2:
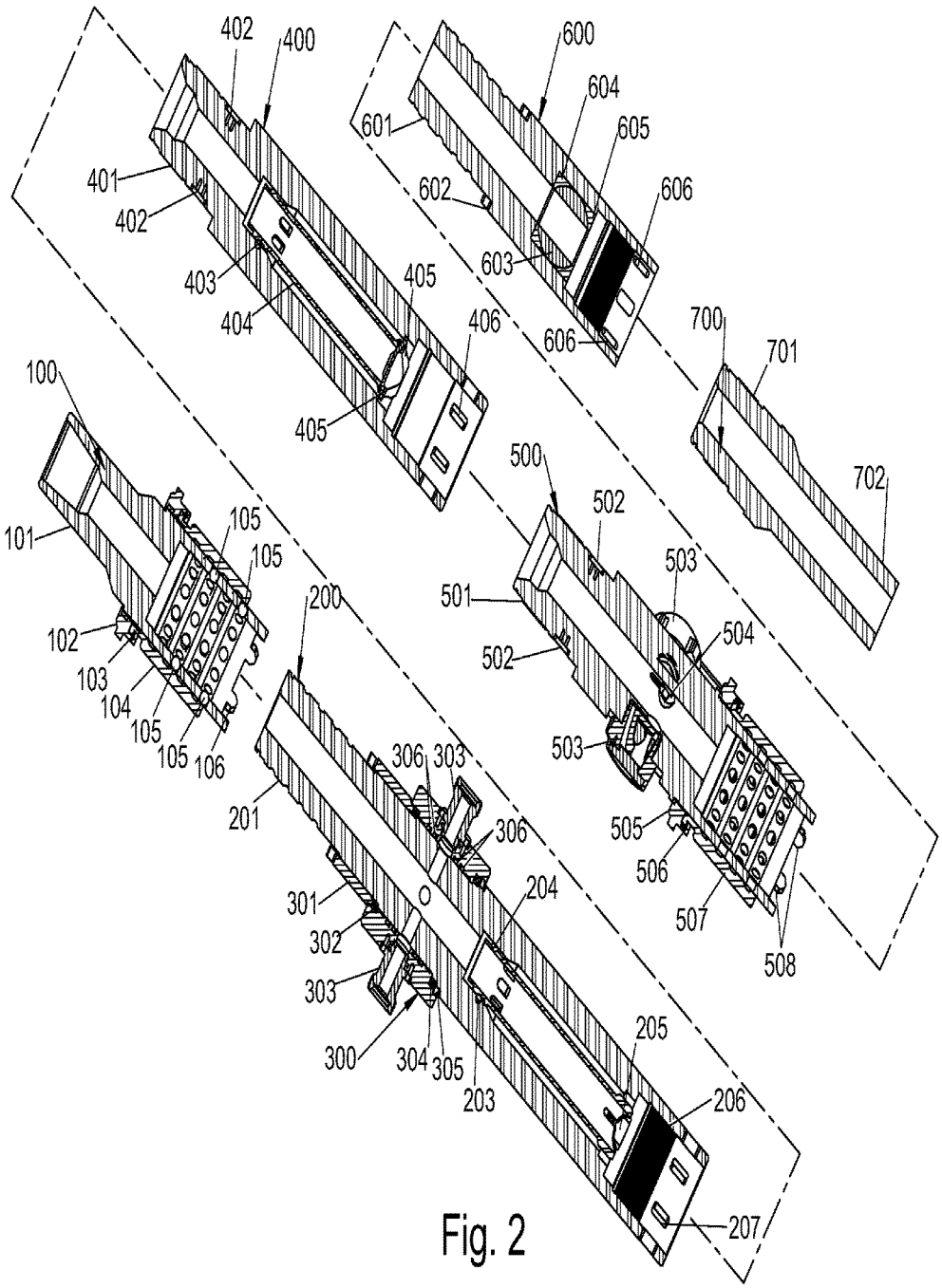
FIG. 2 shows a partial sectional view of the non-threaded, low-torque connection, an upper plug launcher, a cement swivel, a lower plug launcher, a ball drop/flag sub, a shut-in valve and a casing sub. The non-threaded, low-torque connectors shown in FIG. 2 are ball lock assemblies.

Reference is now made to FIG. 2, which shows the structural relationship between the various components in the stack that comprise the cementing tool. FIG. 2 presents the same configuration as discussed above in FIG. 1; however the view is exploded with partial sectional views. Consistent with the above discussion, the upper connector assembly 100 is connected to the components below it via a non-threaded, low-torque connection. In this example, the non-threaded, low-torque connection is a ball lock connector. This connection is further shown in FIGS. 7, 7*a*, 8, and 8*a*, discussed below. The cross sectional exploded view shows that the upper connector assembly 100 is connected to the upper plug launcher 200 using a non-threaded, low-torque connection. The cementing swivel 300 is connected to the upper plug launcher 200; it surrounds the outer circumference of the upper ball dropper 200 and is secured by the connector torque driver 301. The upper plug launcher has three zones: the upper segment that accommodates the connector assembly from above, the middle segment that accommodates the cement swivel 300, and the lower portion that contains the flow through plug cage 204. Openings within the middle section of the upper plug launcher 200 are matched with openings within the cement swivel 300 so as to allow passage of cement into the cementing tools through cement nozzles 303. In this embodiment, the cement nozzles are detachable twist lock bolted cement nozzles. One example of a detachable twist lock bolted cement nozzle connection is a Weco® connection. Further, details of the cementing swivel are presented in FIGS. 4, 4*a*, 5 and 5*a*. The lower end of the upper plug launcher 200 is connected to the upper end of the lower plug launcher 400 and the lower end of the lower plug launcher 400 is connected to the upper end of the ball drop/flag sub 500. Additionally, details of the plug launchers may be found in FIGS. 3 and 3*a*, and is discussed below.

The ball drop/flag sub 500 also has three zones: an upper zone, that in this embodiment has a male threaded connection 501 (that is connected to the female threaded connector 406 at the lower end of the lower plug launcher 400), a middle zone that has a ball dropper 503 and an automatic resetting flag indicator 518, and a lower zone that contains a non-threaded, low-torque connection that connects to the top of the shut-in ball valve 600 component. Additional detail of the ball drop/flag sub is contained in FIGS. 11, 11*a*, 12, 12*a*, and is discussed in further below. The shut-in ball valve 600 component also has three zones: at the top, the male connector pin 601 (that is connected to the bottom of the of the ball drop/flag sub 500), the middle zone contains a ball valve which consist of a ball 604, an upper ball seal 603, and a lower ball seal 605 and, the lower zone which contains a torque driver pocket 606. The lower zone of the shut-in ball valve 600 is connected to the male threaded connection 701 of the top casing sub 700.

Figure 3:
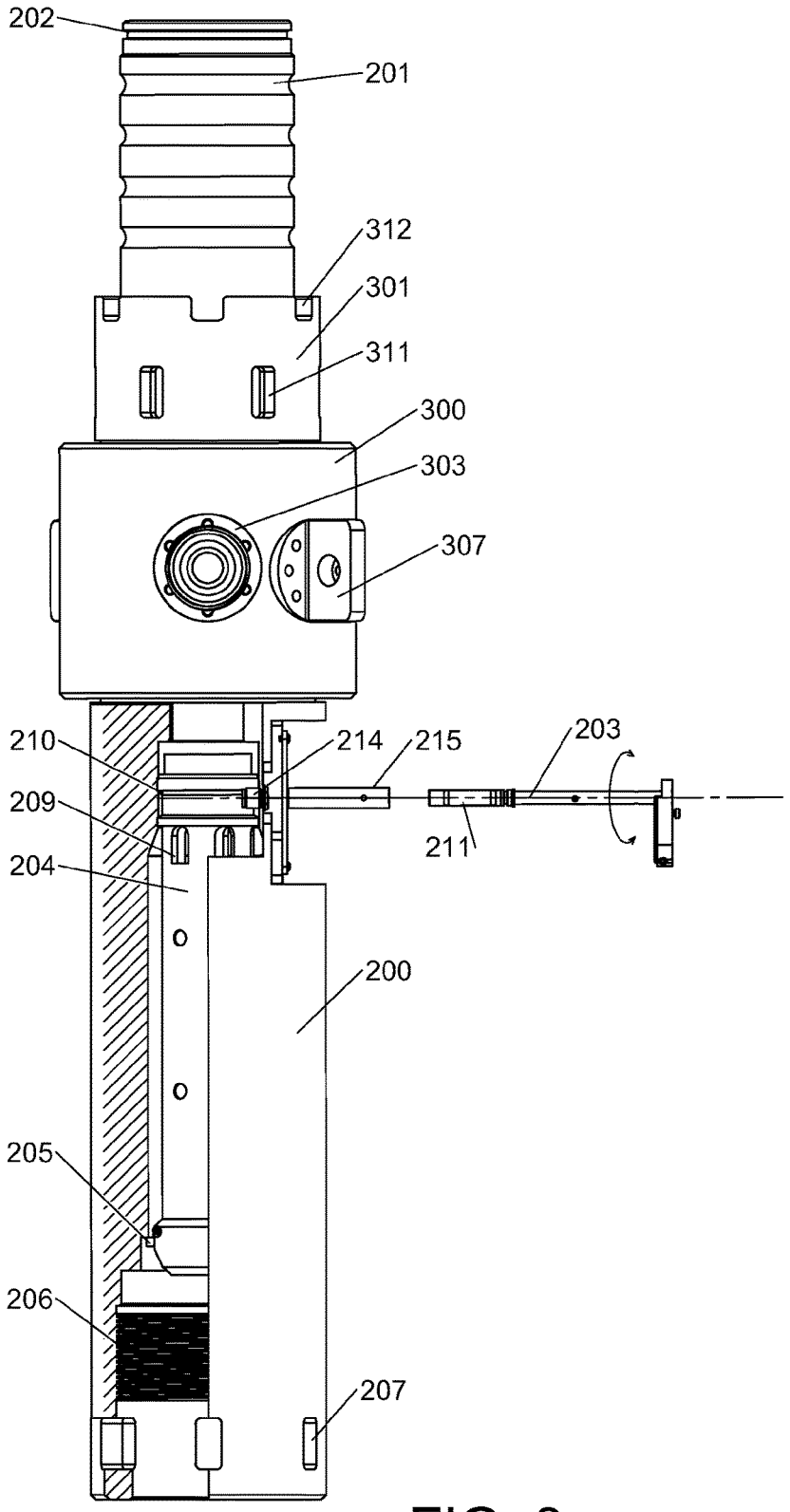
FIG. 3 shows a partial sectional detailed view of the upper plug launcher. The non-threaded, low-torque connectors shown in FIG. 3 are all lock assemblies.
Figure 3A:
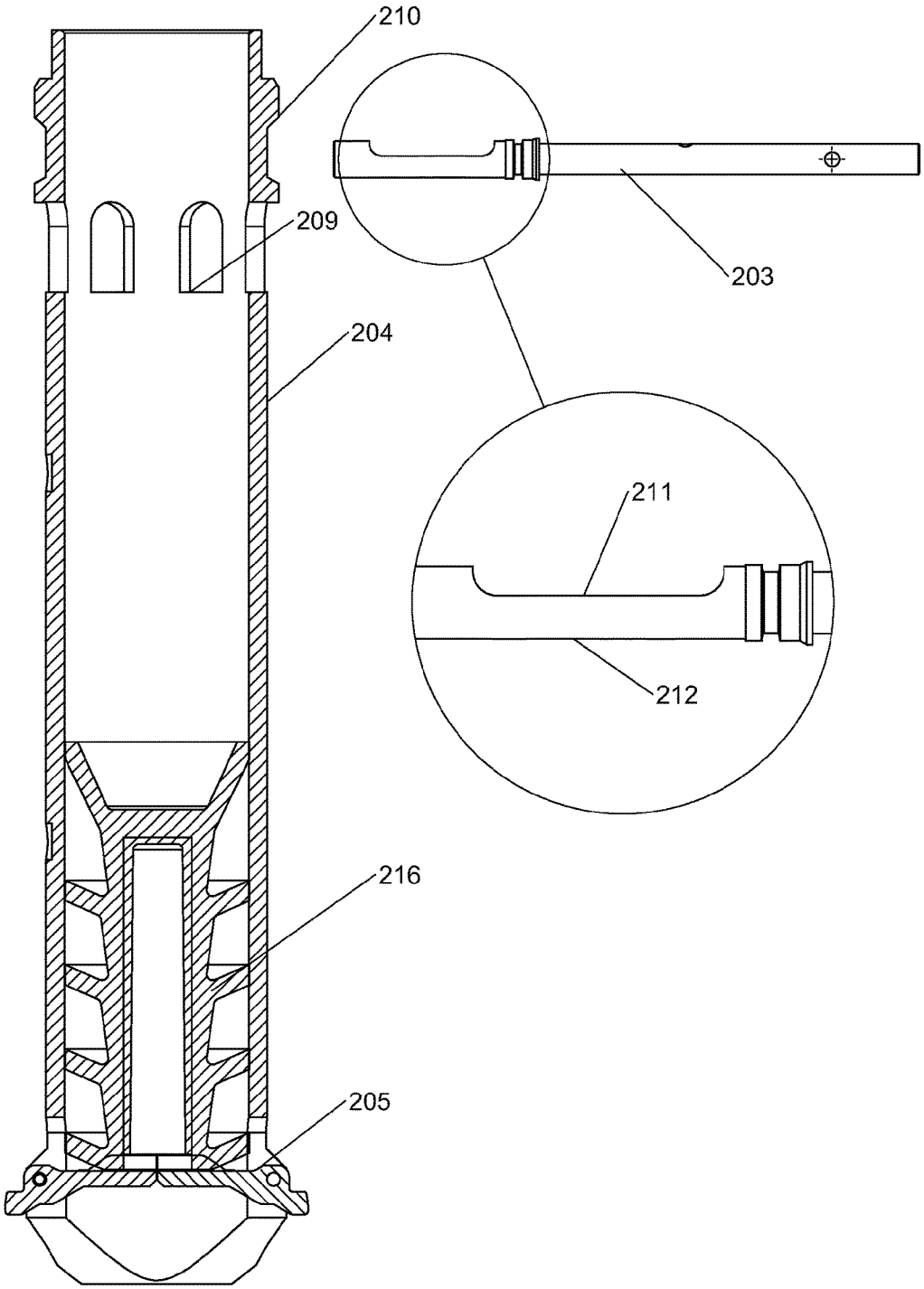
FIG. 3*a* shows a cross sectional view of the plug launching cage.

Referring now to FIGS. 3 and 3*a*, as discussed previously, the upper plug launcher has three zones. The upper segment contains an o-ring seal 202 at the extreme tip and is threaded with grooves that accept the ball 105 within the connector assembly. The middle section of the upper plug launcher accommodates the cement swivel 300 that is screwed into place around the upper plug launcher 200. As mentioned previously, openings within the middle section of the upper plug launcher 200 are matched with openings within the cement swivel 300 so as to allow passage of cement into the cementing tools through detachable twist lock bolted cement nozzle connections 303. Additionally, at least one hold back torque padeye 307 may be connected to the side of the cement swivel 300. The padeye 307 on the cement swivel 300 is connected to a torque arm that maintains the swivel 300 in a relatively stationary position while the cement tool is being rotated by the top drive. The cement swivel is locked into place by a connector torque driver 301. Additional details of the cement swivel 300 are contained in FIGS. 4, 4*a*, 5 and 6, and discussed below.

A flow through plug cage 204 is located within and toward the bottom half of the upper plug launcher 200. The plug cage 204 is held in place by a cage lock 212. When being held in place, fluid pumped down the upper plug launcher 200 flows through the annulus space between the outer wall of the plug cage 204 and the inner wall of the upper plug launcher 200. The plug cage 204 is held in place by the uncut surface of the cage lock 212. Rotation of the plug launching pin 203 results in rotation of the cage locks 212. When the cut surface 211 faces the plug cage, frictional forces that held the plug cage 204 are eliminated resulting in the downward movement of the plug cage 204. Movement of the plug cage allows fluid to enter the inside of the plug cage 204. This motive force pushes the plug cage 204 down and overcomes the force exerted by the plug launching flappers 205, thereby resulting in the release of the cement plug 216. In the embodiment in FIG. 3, the bottom of the upper plug launcher contains a female threaded connector 206 and a torque driver pocket 207. In other embodiments, the bottom of the upper plug launcher could be connected to components below it via non threaded, low torque connections.

The low torque release pin can be adapted to allow for rotation using an alternate power source and a mechanical actuator. Such a configuration would allow for remote control of the release pin. It is expected that in one preferred embodiment, it will require no more than 120 in-lbs of torque to rotate the release pin and release the plug launcher.

Referring now to the embodiment presented in FIGS. 4, 4*a*, 5 and 6, the cement swivel 300 has a hollow cylinder shape, thus allowing it to be placed around the outer circumference of the upper half of the upper plug launcher 200. The cement swivel 300 has openings in the sidewall capable of accepting a threaded cement nozzle referred to as a twist lock bolted cement nozzle connections 303. Additionally, other openings in the side wall of the cement swivel are capable of accepting twist lock hold back torque padeyes 307 having male twist locks 309. Cement nozzles may be connected in additional manners, including permanent connections such as via welding.

On one end, the cement nozzle connection 303 has a male threaded connector. On the other end, the cement nozzle connection 303 has a flange (with a series of connector holes) and a male twist lock 309 with a sealing o-ring 310 on the end. The second end of the cement nozzle connector 303 is inserted into the opening in the side of the cement swivel 300, with the male twist lock 309 initially matching the female twist lock pocket 308. The cement nozzle connection 303 is locked into place by rotating it clockwise and further secured use of retainer screws. In the preferred embodiment, the cement nozzles are removable. By making the cement nozzle 303 removable, the ability to clean and maintain the cement swivel is enhanced; handing of hardened cement within permanent fixtures would be problematic.

Two examples of non-threaded, low-torque connectors are discussed within this application: ball lock connectors, and 45 degree turn connectors. Use of non-threaded low-torque connections allows for breaking down the tool by hand, requiring no special torquing equipment.

Figure 7:
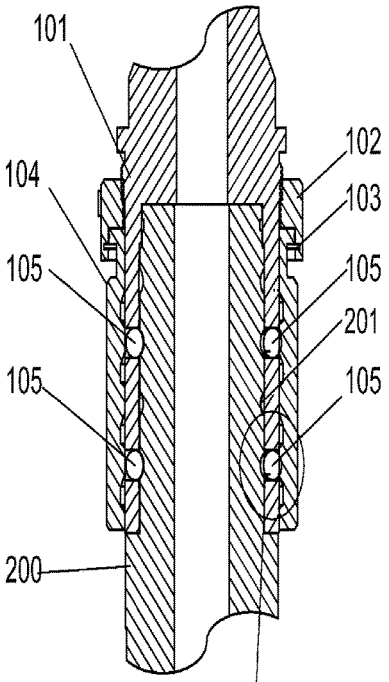
FIG. 7 shows a cross sectional view of the ball joint connection.
Figure 7A:
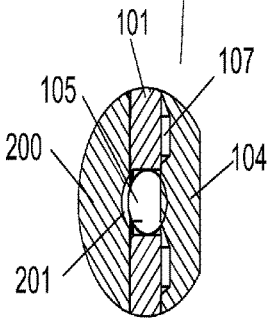
FIG. 7*a* shows an expanded cross sectional view of the ball element as it rests in the ball landing ring.
Figure 8:
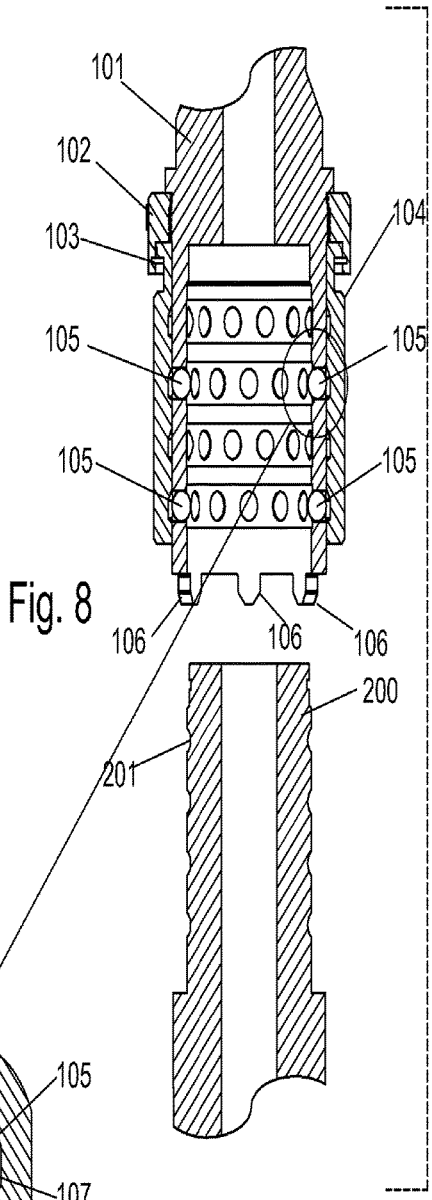
FIG. 8 shows a partial sectional view of the ball joint connection.
Figure 8A:
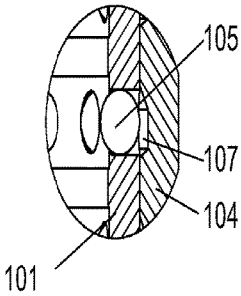
FIG. 8*a* shows a partial sectional view of the ball element in relation to the female socket.

Reference is now made to FIGS. 7, 7*a*, 8 and 8*a* and the structure of one example of a non-threaded, low-torque connector: ball lock connections. FIG. 7 is a cross sectional of mated upper and lower connectors. The (upper) female ball lock socket 101 fits over and around the upper plug launcher 200. Ball elements 105, held within gaps in the female ball socket 101, match with grooves along the outer circumference of the upper plug launcher 200. These grooves are designated as ball landing rings 201. Rotation of the locking nut 102 relative to the retaining ring arrangement 103 secures the connection.

Figure 9:
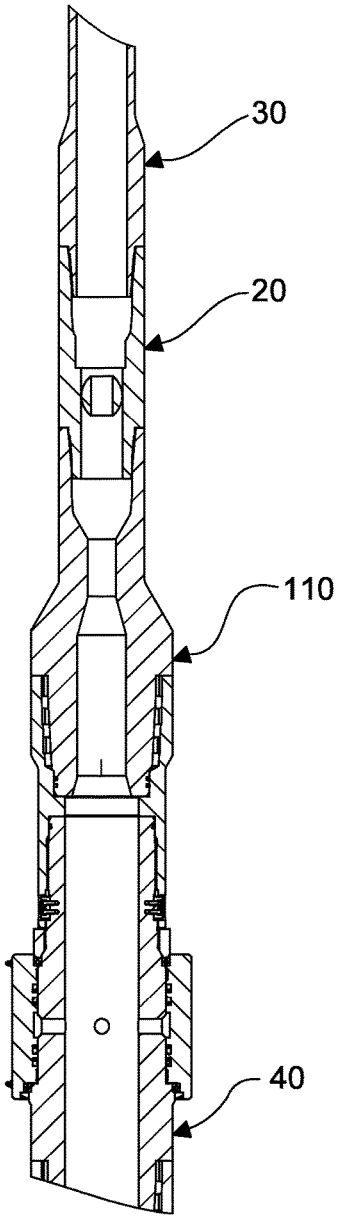
FIG. 9 depicts a side sectional view of the connection assembly of the present invention, shown with its components in mating relationship, incorporated within a representative tool combination.
Figure 10:
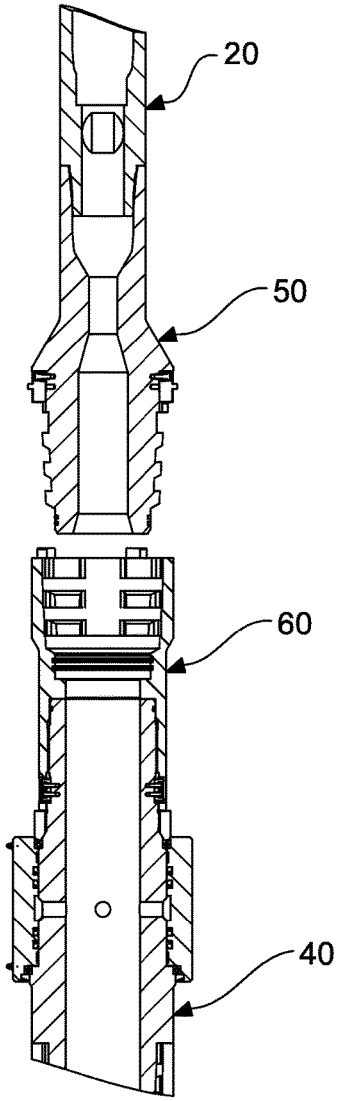
FIG. 10 depicts a side sectional view of the connection assembly of the present invention, shown with its components in detached relationship, incorporated within a representative tool combination.

Reference is now made to FIGS. 9, and 10 and the structure of one example of a non-threaded, low-torque connector: 45 degree turn connections. FIG. 9 depicts a side sectional view of connection assembly 10 of the present invention, in mating relationship, incorporated within a representative tool combination comprising top drive quill 30, valve assembly 20 and cement head 40. By way of illustration, but not limitation, it is to be observed that such tool combination, or other variation or combination of tools, may be encountered at or near the rig floor of a drilling rig.

FIG. 10 depicts a side sectional view of connection assembly 10 of the present invention incorporated within a representative tool combination; as depicted in FIG. 10, said connection assembly 10 is in a detached or disconnected relationship. Specifically, as depicted in FIG. 10, male pin-end connection member 50 is disconnected and removed from female box-end connection member 60.

Torque forces are then applied to rotate pin-end connection member 50 about its longitudinal axis, typically in clock-wise direction, relative to box-end connection member 60. It is to be observed that the specific amount of relative rotation of said members can be adjusted for different operational parameters. However, in the preferred embodiment, pin-end connection member 50 is rotated approximately one-quarter turn relative to box-end connection member 60. While the lugs of each particular connection member (box and pin) are phased about 90 degrees apart, the members are only rotated about 45-degrees relative to each other during make up/break up.

Figure 11:
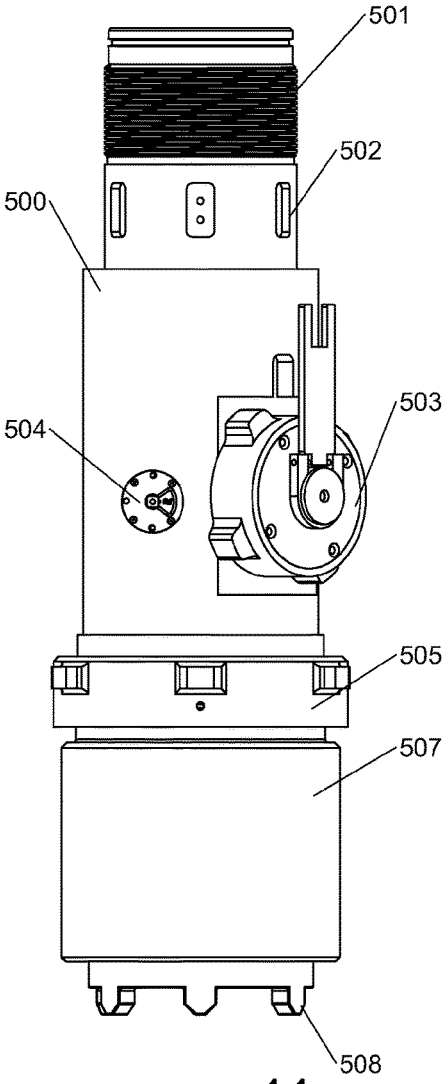
FIG. 11 shows a side view of the ball drop/flag sub component.
Figure 11A:
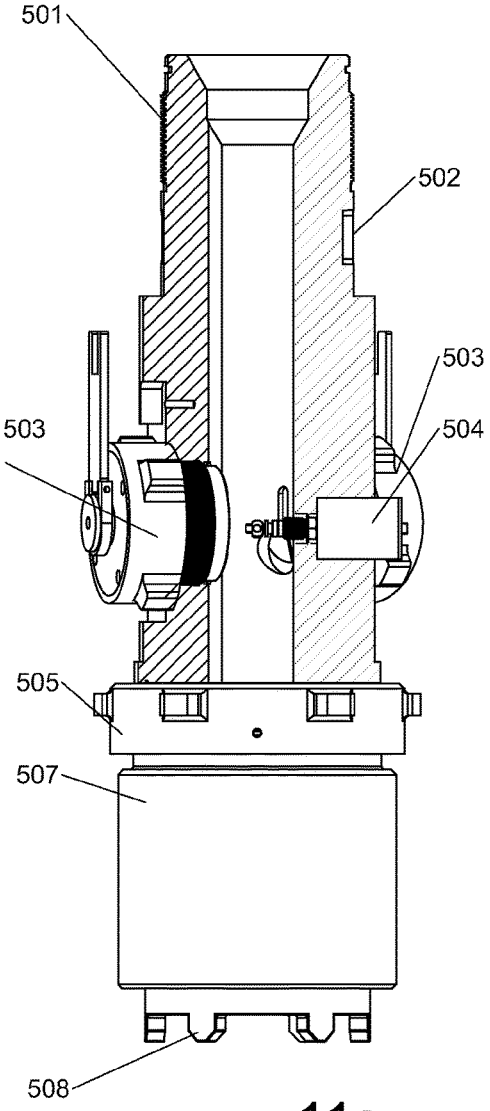
FIG. 11*a* shows a partial sectional view of the ball drop/flag sub component.

Reference is now made to FIGS. 11 and 11*a*, which present a side view and a partial sectional view of the ball drop/flag sub 500. In this embodiment, the top of the ball drop/flag sub 500 has a male threaded connection 501 (for attachment to the bottom of the lower plug launcher 400). In other embodiments, the top of the ball drop/flag sub 500 may have non-threaded, low torque connections. An indicator, comprising interconnected components (504 and 510-520), and a ball dropper 503 are attached to the outer sidewall of the ball drop/flag sub 500. The automatic resetting flag indicator 518 counts the number of times that cement plugs 216 pass that point in the cementing tool. A non-threaded, low-torque connection is used to connect the bottom of the ball drop/flag sub 500 to the upper portion of the shut-in ball valve 600. In this example, the non-threaded, low-torque connector located at the bottom of the ball drop flag sub 500, and illustrated in FIGS. 11 and 11*a*, is a ball lock connector. Other non-threaded, low-torque connectors may be used. Consistent with non-threaded, low-torque connections, the lower end of the ball drop flag sub has a locking nut 505, an outer ball setting sleeve 507 (covering, the non-threaded, low-torque connection), and torque driver lugs 508 which match up with the torque driver 602 at the top of the shut-in ball valve 600.

Figures 12, 12A:
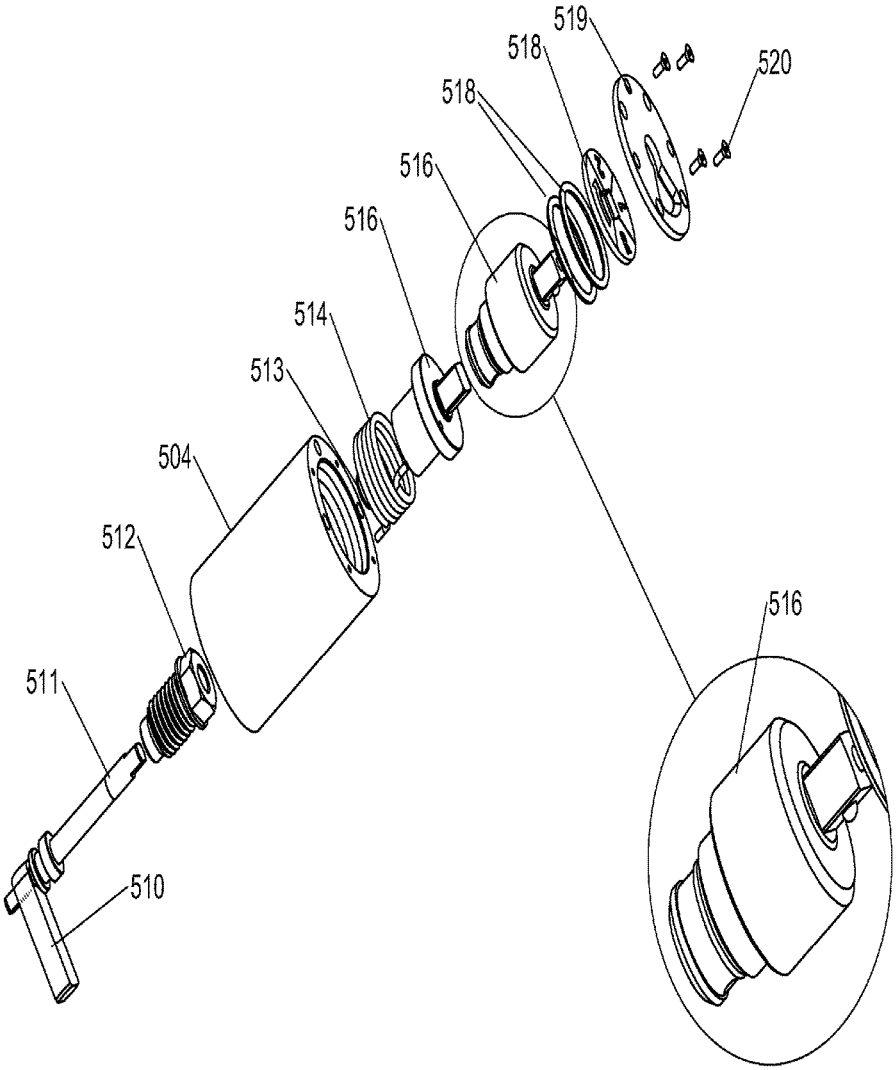
FIG. 12 shows an exploded view of the flag mechanism.
FIG. 12*a* shows an expanded view of the ratchet adapter.

Reference is now made to FIG. 12 which shows an exploded view of the automatic resetting flag. On the internal end of the mechanism there is a flag trigger 510. Movement of cement plugs 216 past the flag trigger 510 causes the trigger to rotate around the axis of the flag shaft 511. This rotating motion is transferred to a flag shaft gland 512 that transfer the rotational energy to the reset torsion spring 514 which transfers the elastic potential energy through the ratchet adapter 516 which causes it to rotate. This rotation causes the flag indicator 518 to likewise rotate, increasing the number exposed by one. After the cement plug 216 passes the flag trigger 510, the residual elastic potential energy left in the reset torsion spring 514 is released and the flag trigger 510 returns to its original position (as it is free to do so). Since the other end of the reset torsion spring 514 is attached to the ratchet 516, its position is fixed allowing release of the tension only at the flag trigger 510 end. The flag indicator 518, located at the external end of the mechanism, is covered by a plate with a flag indicator window 519, so as only to expose the number that relates to the number of cement plugs 216 that have passed.

Alternatively, other systems and methods of presenting or transmitting the data (number of plugs deployed) may be used, such as wired or wireless transmission to another location, and these systems and methods may include alarms and acknowledgment requirements. The flag apparatus may alternatively have a plurality of cams mounted on the flag shaft that activate a plurality of micro-switches for remote electrical indication of the flag status (count); such could be configured to give continuous indication until reset. Additionally, the apparatus could be configured to present the count mechanically with the flag indicator window 519 and through an electrical indication, using one as back-up for the other.

The cementing tool, as configured in FIG. 1, is operated in the following manner. Use of the tool is initiated by pumping a fluid, usually water, cement or drilling mud, through the cement nozzles 303. Fluid initially flows through the inner tube (not numbered in figure) of the upper plug launcher 200 until it reaches the upper plug launcher cage 204. At this point, flow is diverted from the center tube and flows through the annular space between the outside of the upper plug launcher cage 204 and the inner wall of the upper plug launcher 200. After the flow passes the upper plug launcher cage 204, it returns to the center passageway and out of the upper plug cage launcher 204. Fluid leaving the upper plug cage launcher 204 enters the inlet of the lower plug launcher and passes through the central passage way in the lower plug launcher 400 until it reaches the lower plug launcher cage 404. At this point, flow is diverted from the center tube and flows through the annular space between the outside of the lower plug launcher cage 404 the inner wall of the lower plug launcher 400. The fluid then passes freely through the rest of the cementing tool and into the casing below.

Just prior to switching the pumped fluid to cement, flow of the (non-cement) fluid is stopped and allowed to pass though the cement tool so that it is relatively empty. In the next operation step, the low torque rotating plug launching pin 403 on the lower plug launcher 400 is rotated, releasing the plug cage 404. At this point, the cement plug 216 is still retained by the plug launching flapper 405.

Cement is pumped down the cementing tool, initially in a manner consistent with the path discussed above. The cement flows through the annular space between the outside of the upper plug launcher cage 204 and the inner wall of the upper plug launcher 200. However, since the plug cage 404 in the lower plug launcher has been released, cement flows into the interior of the plug cage 404. Hydraulic pressure from the cement flow pushes the plug cage downward until movement of the outer lip of the plug launching flapper 405 is restricted, causing the retaining or inner portion of the flapper to rotate around a fixed point, resulting in the movement of the flapper so as to allow release of the cement plug 216. As the cement plug passes through the ball drop flag sub 500, it causes the flag trigger to move, resulting in the rotational movement of the flag shaft 511, resulting in advancing the flag indicator 518 (counter) by a single digit.

At the point that a sufficient quantity of cement has been pumped down the cementing tool, flow of cement is discontinued. Cement is allowed time to essentially clear the cementing tool and the low torque rotating plug launching pin 203 on the upper plug launcher 200 is rotated, releasing the plug cage 204. At this point, the cement plug 216 is still retained by the plug launching flapper 205.

Since the plug cage 204 in the upper plug launcher 200 has been released, cement flows into the interior of the plug cage 204. Hydraulic pressure from the flowing cement pushes the plug cage downward until movement of the outer lip of the plug launching flapper 205 is restricted, causing the retaining or inner portion of the flapper to rotate around a fixed point, resulting in the movement of the flapper so as to allow release of the second cement plug 216. As the second cement plug passes through the ball drop/flag sub 500, it causes the flag trigger to move, resulting in the rotational movement of the flag shaft 511, resulting in advancing the flag indicator 518 (counter) by another digit.

Advantages of the improved cementing tool, in addition to those listed above, include the ability to inspect plugs without specialized torquing equipment. The use of non-threaded, low-torque connections, such as between the upper connector assembly 100 and the upper plug launcher 200, allows quick disconnection between the sections, allowing on sight-inspection or reconfiguration. Furthermore, separation of threaded connectors requires rotation of the entire piping or casing string which at time may be undesirable. Use of non-threaded, low-torque connections allows for breaking the tool down with rotation of the string.

There are, of course, other alternate embodiments which are obvious from the foregoing descriptions of the invention, which are intended to be included within the scope of the invention, as defined by the following claims.

INDUSTRIAL APPLICABILITY

This invention has applicability in the completion of subterranean wells. Subterranean wells, especially oil and gas wells, contain downhole casing pipe for various reasons, among which include the requirement to isolate one subterranean zone form another. As part of those operations, cement is routed to the annular space between the casing pipe and the borehole. The mater disclosed herein is a tool used to facilitate such cementing operations.

We claim:

1. A well cementing tool having a top end and a bottom end, said well cementing tool comprising:

a. a cementing swivel component at said top end, said cementing swivel component comprising a hollow cylindrical section with a sidewall and detachable nozzles attached to said side wall;

b. a plurality of plug launcher components connected to said cementing swivel component and above said bottom end, each of said plug launchers comprising a low torque rotational plug release and a flow through cage that launches a plug when said plug release is set to a release position;

c. where said plurality of plug launcher components comprise an upper plug launcher and a lower plug launcher;

d. a plug launcher counting device intermediate said plug launchers and said bottom end, said plug launch counting device comprising:

1. a sensing device to detect the passage of each said plug, 2. a means of indicating the number of plugs launched, and 3. a ball drop; and e. non-threaded, low-torque connections at said top end and said bottom end, said non-threaded, low-torque connections being specially adapted to connect said well cementing tool without the use of torqueing equipment.

2. The apparatus of claim 1, where said non-threaded, low-torque connections are secured by ball lock connectors.

3. The apparatus of claim 1, where said non-threaded, low-torque connections are secured by 45 degree turn connectors.

4. The apparatus of claim 1, where said means of indicating the number of plugs launched is a mechanical counter.

5. The apparatus of claim 1, where said means of indicating the number of plugs launched is accomplished by creating an electronic signal that is converted to a visual indicator.

6. The apparatus of claim 1, where said plurality of plug launchers are joined by non-threaded, low torque connectors.

7. The apparatus of claim 1, where said upper plug launcher and said cement swivel component are combined into a single modular unit.

8. The apparatus of claim 1, where said upper plug launcher and said cement swivel components are separate modular units connected by non-threaded, low-torque connections.

9. The apparatus of claim 8, where said upper plug launcher and said lower plug launcher are identically configured and interchangeable.

10. A well cementing tool having a top end and a bottom end, said well cementing tool comprising:

a. a cementing swivel component at said top end;

b. a plurality of plug launcher components connected to said cementing swivel component and above said bottom end, each of said plug launchers comprising a low torque rotational plug release and a flow through cage that launches a plug when said plug release is set up to a release position;

c. where said plurality of plug launcher components comprise an upper plug launcher and a lower plug launcher; and d. a plug launch counting device intermediate said plug launchers and said bottom end, said plug launch counting device comprising:

1. a sensing device to detect the passage of each said plug, 2. a means of indicating the number of plugs launched, and 3. a ball drop.

* * * * *